US009889910B2

(12) United States Patent
Zimmerman

(10) Patent No.: US 9,889,910 B2
(45) Date of Patent: Feb. 13, 2018

(54) FENDER HANGER DEVICE

(71) Applicant: Ronald C. Zimmerman, Marvin, NC (US)

(72) Inventor: Ronald C. Zimmerman, Marvin, NC (US)

( * ) Notice: Subject to any disclaimer, the term of this patent is extended or adjusted under 35 U.S.C. 154(b) by 0 days.

(21) Appl. No.: 15/586,357

(22) Filed: May 4, 2017

(65) Prior Publication Data

US 2017/0327194 A1 Nov. 16, 2017

Related U.S. Application Data

(60) Provisional application No. 62/335,792, filed on May 13, 2016, provisional application No. 62/405,529, filed on Oct. 7, 2016.

(51) Int. Cl.
*B63B 59/02* (2006.01)
*F16M 13/02* (2006.01)

(52) U.S. Cl.
CPC ..... *B63B 59/02* (2013.01); *F16M 13/02* (2013.01)

(58) Field of Classification Search
CPC ... B63B 59/02; B63B 22/02; B63B 2059/025; B63B 21/00; E02B 3/26; F16M 13/02; B63C 3/02
USPC ..... 114/230.29; 24/130
See application file for complete search history.

(56) References Cited

U.S. PATENT DOCUMENTS 1,466,495 A * 8/1923 Watson ..... F16G 11/10 24/129 R
3,650,236 A * 3/1972 McFarlane ..... B63B 21/08 114/218
4,453,486 A * 6/1984 Harken ..... B63B 21/08 114/218
5,016,554 A * 5/1991 Harris, Jr. ..... E02B 3/26 114/219
7,293,745 B2 * 11/2007 Catapano ..... F16L 3/222 248/61
2011/0132249 A1 * 6/2011 Loisel, Jr. ..... B63B 59/02 114/219

* cited by examiner

*Primary Examiner* — Anthony D Wiest
(74) *Attorney, Agent, or Firm* — Patentfile, LLC; Bradley C. Fach; Steven R. Kick

(57) ABSTRACT

A fender hanging device may include a back plate coupled to a first arm and to a second arm. A cavity may be formed between the back plate, the first arm, and the second arm. A channel may separate the first arm and second arm. An upper limiter may be coupled to the back plate opposite the first arm and second arm, and a block aperture may pass through the upper limiter. Optionally, a flexible linkage having a body with one or more linkage fasteners coupled to the body. A fender retainer may be coupled to the flexible linkage, and the fender retainer may have an annular frame. A fender may be coupled to the annular frame, and the fender may be movable between a first position, a second position, and/or any number of other positions.

18 Claims, 6 Drawing Sheets

FENDER HANGER DEVICE

CROSS REFERENCE TO RELATED APPLICATIONS

This application claims priority to and the benefit of the filing date of U.S. Provisional Application No. 62/335,792, filed on May 13, 2016, entitled "FENDER HANGER DEVICE", which is hereby incorporated by reference in its entirety. Additionally, this application claims priority to and the benefit of the filing date of U.S. Provisional Application No. 62/405,529, filed on Oct. 7, 2016, entitled "FENDER HANGER DEVICE", which is hereby incorporated by reference in its entirety.

FIELD OF THE INVENTION

The present application relates to the field of devices for positioning boat fenders. More specifically, this patent specification relates to devices configured to dispose a boat fender in a plurality of positions for use with boating vessels including, sail or power boating for commercial or pleasure use.

BACKGROUND

When bringing a small boat or pleasure craft, of which many types exist, adjacent to a dock, it is important to safe guard the hull preventing direct contact with the dock structure. The dock structure is usually a type of horizontal platform, which many vary in height off the water dependant on many factors. It also may consist of vertical or diagonal supports.

Currently, when a boat is docked, the protective fenders must be placed in an aspect opposite of the point of contact. A horizontal platform dock requires a vertical fender. On the other hand, a vertical support column or pier post requires a horizontal fender, and a diagonal support needs an opposingly diagonal fender.

Current fender hanger devices are so configured to only address the need of one dock type at a time, necessitating a time consuming reconfiguration to convert to an opposite or variant aspect need.

Therefore, there exists a need for a novel device configured to quickly protect a boats hull, but one that requires no apparatus change out, or time consuming readjustments.

BRIEF SUMMARY OF THE INVENTION

A fender hanging device is provided which is configured to dispose a boat fender in a plurality of positions for use with boating vessels including, sail or power boating for commercial or pleasure use. In some embodiments, the device may include a back plate coupled to a first arm and to a second arm. A cavity may be formed between the back plate, the first arm, and the second arm. A channel may separate the first arm and second arm. An upper limiter may be coupled to the back plate opposite the first arm and second arm, and a block aperture may pass through the upper limiter.

In some embodiments, the device may include a flexible linkage having a body with one or more linkage fasteners coupled to the body. A fender retainer may be coupled to the flexible linkage, and the fender retainer may have an annular frame. A fender may be coupled to the annular frame, and the fender may be movable between a first position, a second position, and/or any number of other positions.

In further embodiments, the device may comprise a hanger block, a flexible linkage, a fender retainer, and a fender. The fender may be coupled to the flexible linkage, preferably via the fender retainer. The flexible linkage may be removably coupled to the hanger block at various locations along the length of the flexible linkage. By removably coupling the flexible linkage to the hanger block at different locations, the fender may be positioned at various distances or positions from the hanger block while being supported by the hanger block. Optionally, the fender may be movably coupled to the flexible linkage via a fender retainer, thereby allowing the fender to be positioned in two or more positions or orientations relative to the flexible linkage, such as between a first position and a second position.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Figure 1:
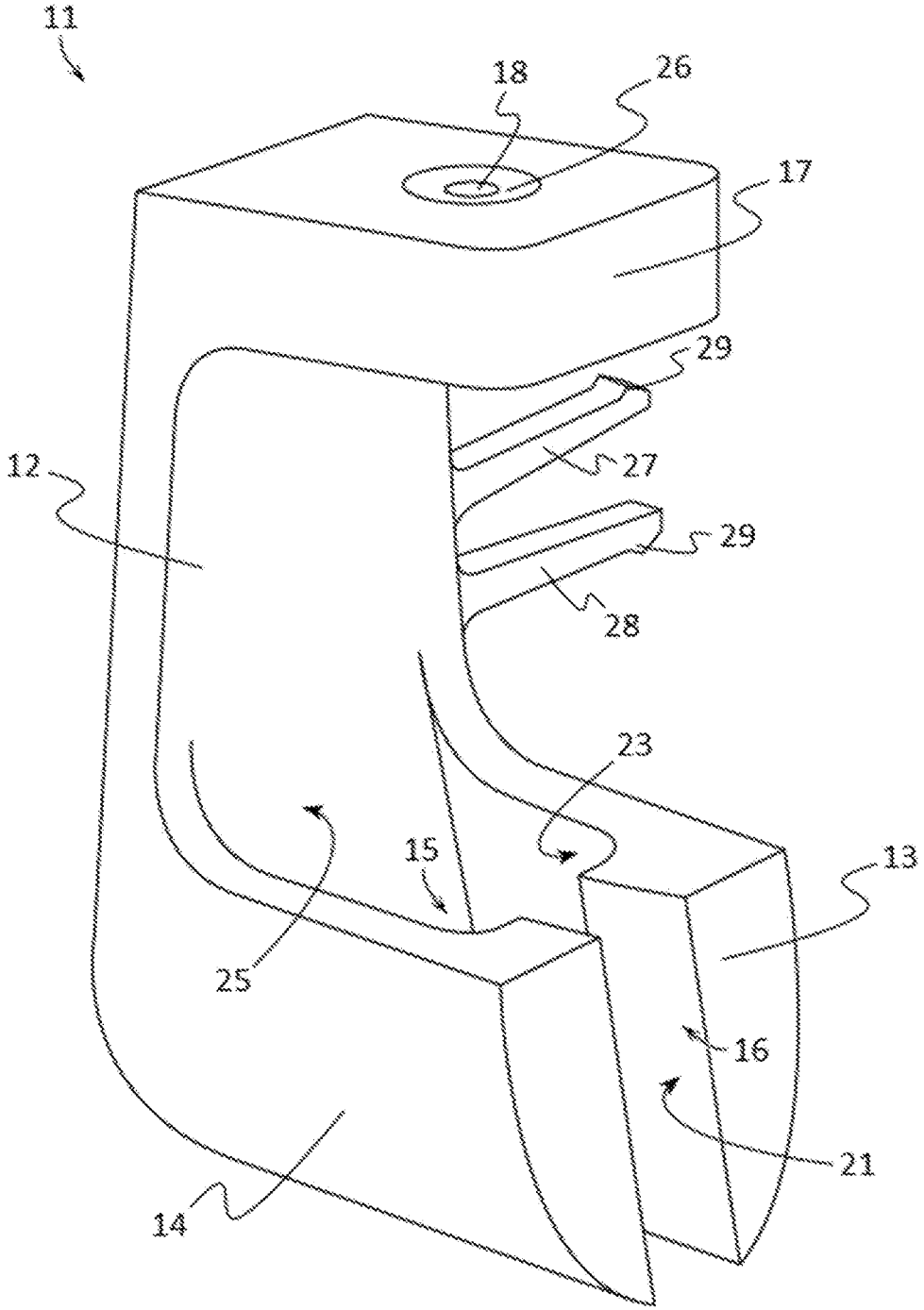
FIG. 1 depicts a front perspective view of an example of a hanger block of a fender hanger device according to various embodiments described herein.
Figure 2:
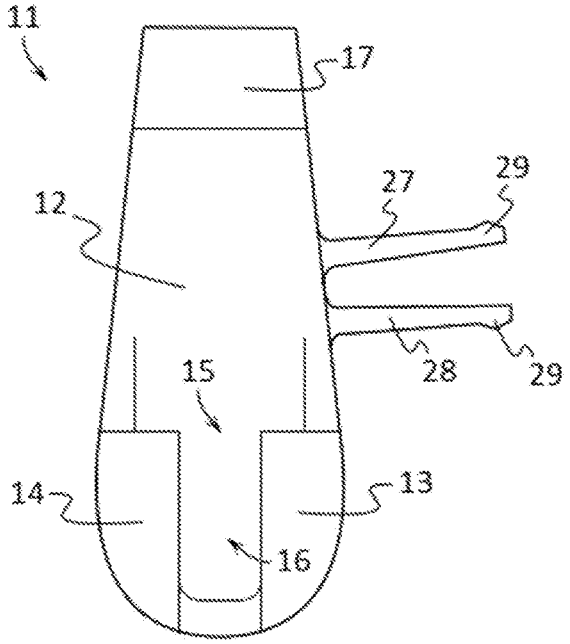
FIG. 2 illustrates a front elevation view of another example of a hanger block of a fender hanger device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

A new device for positioning boat fenders is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 6:
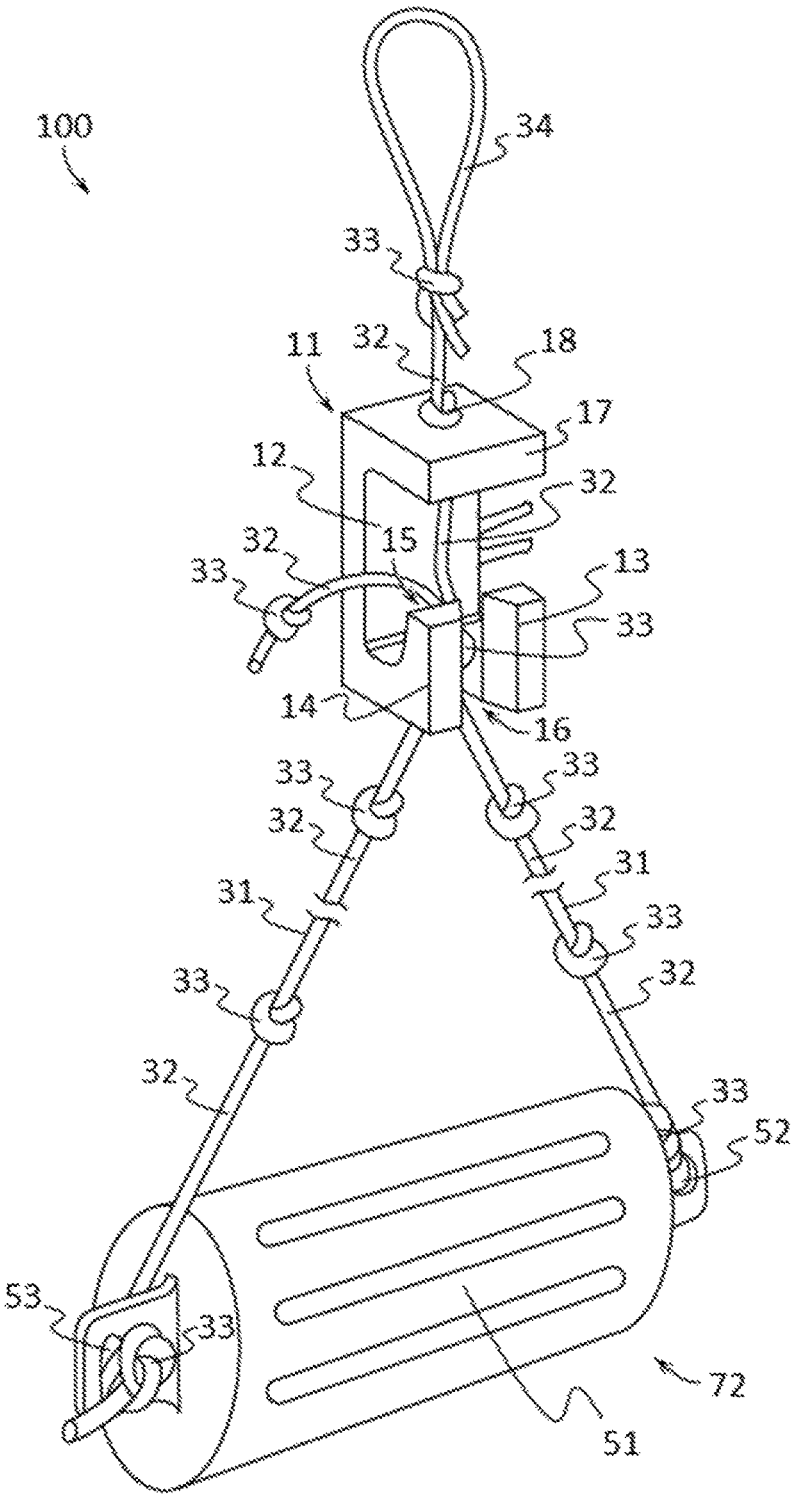
FIG. 6 shows a perspective view of an example of a fender hanger device according to various embodiments described herein.

The present invention will now be described by example and through referencing the appended figures representing preferred and alternative embodiments. FIGS. 6 and 9 illustrate examples of a fender hanging device ("the device") 100 according to various embodiments. In some embodiments, the device 100 may comprise a hanger block 11, a flexible linkage 31, a fender retainer 41, and a fender 51. The fender 51 may be coupled to the flexible linkage 31, preferably via the fender retainer 41. The flexible linkage 31 may be removably coupled to the hanger block 11 at various locations along the length of the flexible linkage 31. By removably coupling the flexible linkage 31 to the hanger block 11 at different location, the fender 51 may be positioned at various distances or positions from the hanger block 11 while being supported by the hanger block 11. Optionally, the fender 51 may be movably coupled to the flexible linkage 31 via a fender retainer 41, thereby allowing the fender 51 to be positioned in two or more positions or orientations relative to the flexible linkage 31, such as between a first position 71 (FIG. 7) and a second position 72 (FIG. 8).

FIGS. 1-5 depict examples of a hanger block 11 according to various embodiments described herein. In some embodiments, a hanger block 11 may comprise a back plate 12 which may be coupled to a first arm 13 and to a second arm 14. A cavity 15 may be formed between the back plate 12, the first arm 13, and the second arm 14. A channel 16 may separate the first arm 13 and second arm 14. An upper limiter 17 may be coupled to the back plate 12 opposite the first arm 13 and second arm 14, and a block aperture 18 may pass through the upper limiter 17.

A back plate 12, first arm 13, second arm 14, and/or upper limiter 17 may be configured in any shape and size. Generally, the back plate 12 may be used to couple a first arm 13, second arm 14, and/or upper limiter 17 together while maintaining the position of the first arm 13, second arm 14, and/or upper limiter 17 relative to each other. Preferably, the back plate 12, first arm 13, second arm 14, and/or upper limiter 17 may be made from of comprise substantially rigid materials such as metal and metal alloys, wood, hard plastics, hard rubber, fiber glass, carbon fiber, resins, or any other generally rigid and durable material for use in marine environments.

The fender block 11 may comprise a channel 16 which may be shaped to allow portions of a flexible linkage 31 (FIGS. 6-9), such as the body 32, to pass through the channel 16, while preventing other portions of the flexible linkage 31, such as a linkage fastener 33, from passing through the channel 16. A channel 16 may be formed by one or more elements of the hanger block 11. In some embodiments, a channel 16 may be formed into or by a first arm 13, second arm 14, and/or back plate 12. In further embodiments, the channel 16 may comprise a forward portion 19 and a bottom portion 20. A forward portion 19 may enable the body 32 of a flexible linkage 31 to pass through the channel 16 by being moved towards and away from the back plate 12, while a bottom portion 20 may enable the body 32 of a flexible linkage 31 to pass through the channel 16 by being moved towards and away from the upper limiter 17.

In preferred embodiments, the channel 16 may be formed by a first arm 13 and a second arm 14. The first arm 13 may comprise a first channel surface 21 and the second arm 14 may comprise a second channel surface 22. The channel surfaces 21, 22, may define the portions 19, 20, of the channel 16. By moving the body 32 of a flexible linkage 31 between the channel surfaces 21, 22, the flexible linkage 31 may be moved into, out of, and through the channel 16. In preferred embodiments, the channel surfaces 21, 22, may be separated from each other by a distance that is approximately greater than or equal to the width of the body 32 of the flexible linkage 31 and that is approximately less than the width of a linkage fastener 33 coupled to the body 31 of the flexible linkage 31. In this manner, the body 31 may be moved into, out of, and through the channel 16, while the one or more linkage fasteners 33 may not be moved into, out of, and through the channel 16, thereby allowing a linkage fastener 33 to limit the movement of the flexible linkage 31 through the channel 16.

The hanger block 11 may comprise a cavity 15 which may be formed between the back plate 12, the first arm 13, and/or the second arm 14. The cavity 15 may be shaped to receive portions of a linkage fastener 33 while the body 32 of the flexible linkage 31 is disposed within the channel 16. A first arm 13 may comprise a first cavity surface 23, a second arm 14 may comprise a second cavity surface 24, and a back plate 12 may comprise a plate surface 25. In some embodiments, a cavity 15 may be formed and bounded by a first cavity surface 23, a second cavity surface 24, and/or a plate surface 25. The surfaces 23, 24, 25, may be complementarily shaped to portions of the linkage fasteners 33 to increase the amount of surface area contact between the hanger block 11 and a linkage fastener 33 while the body 32 of the flexible linkage 31 is disposed within the channel 16.

An upper limiter 17 may be coupled to the back plate 12 opposite the first arm 13 and second arm 14, and a block aperture 18 may pass through the upper limiter 17. The block aperture 18 may be shaped to allow portions of a flexible linkage 31 (FIGS. 6-9), such as the body 32, to pass through the block aperture 18, while preventing other portions of the flexible linkage 31, such as a linkage fastener 33, from passing through the block aperture 18. In this manner, the flexible linkage 31 may be slidably coupled within the block aperture 18. Preferably, a block aperture 18 may be oriented towards the cavity 15 to enable portions of the body 31 disposed within the block aperture 18 to be moved towards and away from the cavity 15. In preferred embodiments, a block aperture 18 may be generally cylindrical in shape having a width that is approximately greater than or equal to the width of the body 32 of the flexible linkage 31 and that is approximately less than the width of a linkage fastener 33 coupled to the body 31 of the flexible linkage 31. In this manner, the body 31 may be moved through the block aperture 18, while the one or more linkage fasteners 33 may not be moved through the block aperture 18, thereby allowing a linkage fastener 33 to limit the movement of the flexible linkage 31 through the block aperture 18. In alternative embodiments, a block aperture 18 may be configured as a channel similar to the channel 16 with the upper limiter 17 split into two arms similar to the first 13 and second 14 arms.

In some embodiments, the block aperture 18 may comprise one or more beveled edges 26. A beveled edge 26 may be generally complementarily shaped to portions of the linkage fasteners 33 to increase the amount of surface area contact between the hanger block 11 and a linkage fastener 33 while the body 32 of the flexible linkage 31 is disposed within the block aperture 18. For example, a beveled edge 26 may be generally concave shaped to receive portions of a generally spherical linkage fastener 33.

In some embodiments, a hanger block 11 may comprise one or more prongs such as a first prong 27 and a second prong 28. The prongs 27, 28, may be positioned anywhere on the hanger block 11 such as on the back plate 12. Preferably the prongs 27, 28, may be configured to removably couple the hanger block 11 to objects such as a fender 51 and fender retainer 41. In some embodiments, a hanger block 11 may comprise a first prong 27 and a second prong 28 which may be separated from each other and configured to be removably coupled to a fender aperture 52, 53, of a fender 51 by inserting the prongs 27, 28, into the fender aperture 52, 53. The prongs 27, 28, may frictionally engage with the fender aperture 52, 53, to maintain the coupling between the hanger block 11 and fender 51. Optionally, a prong 27, 28, may comprise a barb 29 which may protrude away from the prong 27, 28, and further frictionally engage with or increase the frictional engagement between a prong 27, 28, and a fender aperture 52, 53, into which it is inserted. Preferably, a prong 27, 28, and/or a fender aperture 52, 53, may be made from a flexible material to allow the prongs 27, 28, and/or fender aperture 52, 53, to flex in order to facilitate coupling and uncoupling of the prongs 27, 28, and fender aperture 52, 53. In further embodiments, the prongs 27, 28, may be configured to snap onto, around, or attach to each other or to the annular frame 42 so that the fender retainer 41 and hanger block 11 may be removably coupled together.

Figure 3:
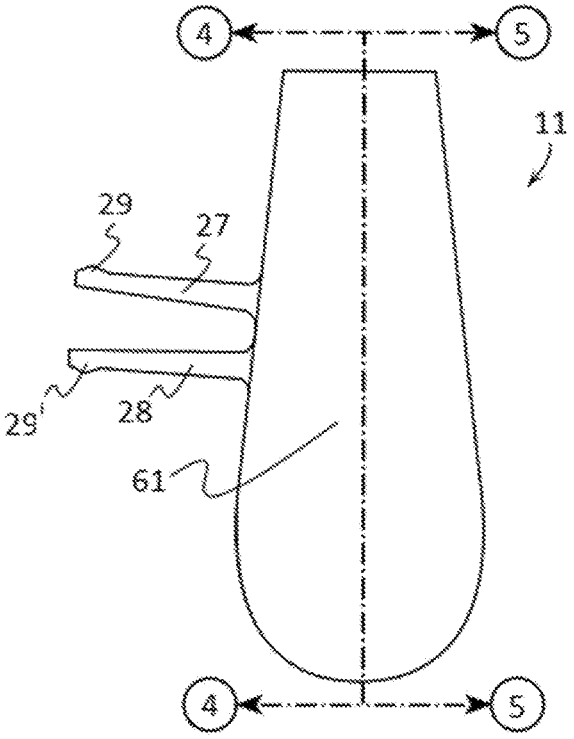
FIG. 3 shows a rear elevation view of another example of a hanger block of a fender hanger device according to various embodiments described herein.
Figure 4:
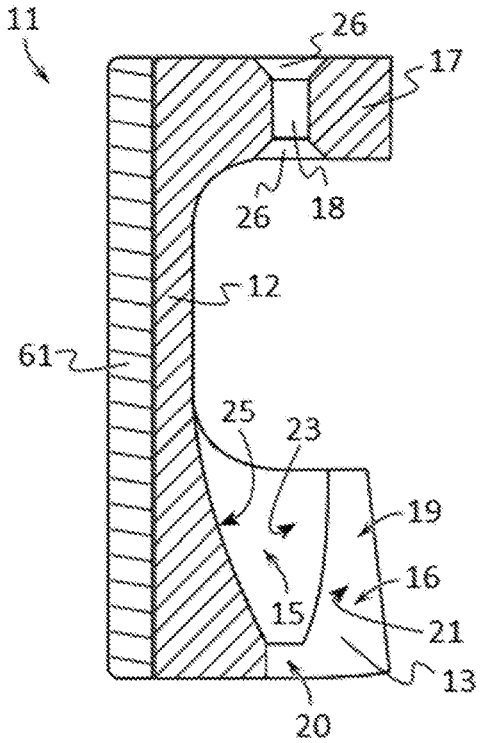
FIG. 4 depicts a sectional, through line 4-4 shown in FIG. 3, elevation view of another example of a hanger block of a fender hanger device according to various embodiments described herein.
Figure 5:
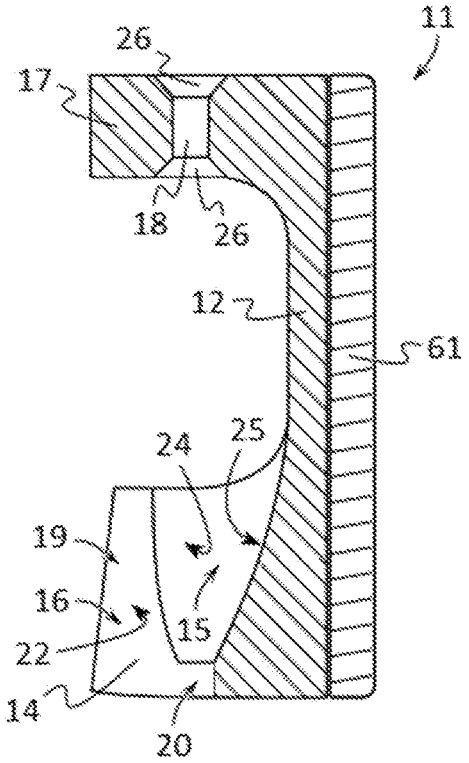
FIG. 5 illustrates a sectional, through line 5-5 shown in FIG. 3, elevation view of another example of a hanger block of a fender hanger device according to various embodiments described herein.

As perhaps best shown in FIGS. 3-5, in some embodiments, the hanger block 11 may comprise one or more cushions 61 which may be positioned anywhere on the hanger block 11 such as on the back plate 12 opposite the arms 13, 14. A cushion 61 may absorb impacts and/or provide a resilient cushioning layer to prevent the hanger block 11 from damaging objects such as boat hulls. A cushion 61 may be configured in any shape and size. In some embodiments, a cushion 61 may comprise a resilient material such as silicone foams, silicone rubber, rubber foams, urethane foams including plastic foams, neoprene foam, latex foam rubber, polyurethane foam rubber, or elastomer materials such as elastic plastics, elastic silicone, elastic rubbers, or any other suitable elastomer or resilient material including combinations of materials which may be suitable for use in marine environments.

Referring now to FIGS. 6-9, in some embodiments, the device 100 may comprise a flexible linkage 31 which may be used to couple a fender 51 to a hanger block 11. The flexible linkage 31 may comprise an elongate body 32 of any length with one or more linkage fasteners 33 positioned along the body 32. In preferred embodiments, an elongate body 32 may be any type of rope suitable for use in a marine environment, such as Nylon Rope, Polypropylene Rope, Polyester rope, Manila Rope, hemp rope, Parachute Cord, and the like. In other embodiments, an elongate body 32 may be any type of cable, chain, string, strap, or the like which may be elongated, having a width greater than its length, and flexible or bendable in materials or construction.

A flexible linkage 31 may comprise one or more linkage fasteners 33 which may be positioned anywhere along the body 32. In some embodiments, a linkage fastener 33 may comprise a knot or other contortion of the body 32. In other embodiments, a linkage fastener 33 may comprise a generally rigid material that may be formed into a substantially spherical, cuboid, pyramidal, or other 3D shape having a width greater than the width of the body 32, thereby allowing the linkage fastener 33 to function as a catch or stop for limiting the movement of the body 32 through a channel 16 and/or a block aperture 18.

In some embodiments, a flexible linkage 31 may comprise a body fastener 34 which may be used to secure or couple the body 32 to objects such as railings, dock cleats, boat cleats, and the like. In some embodiments, a body fastener 34 may be formed by tying portions of the body 32 into a loop which may be placed around and through objects. In further embodiments, a body fastener 34 may comprise a hook, carbineer, buckle, hook and loop type fastener, or any other type of type of fastener which may be used to couple the body 32 to one or more objects.

In some embodiments, the device 100 may comprise a fender 51 which may be coupled to a flexible linkage 31. A fender 51 may be a bumper used to absorb the kinetic energy of a boat or vessel berthing against a jetty, dock, pylon, quay wall, or other vessel. Fenders 51 may be configured to prevent damage to vessels and berthing structures. To do this, fenders 51 have high energy absorption and low reaction force. Fenders 51 are typically manufactured out of rubber, foam elastomer, or plastic. Fenders 51 may comprise one or more fender apertures, such as a first fender aperture 52 and a second fender aperture 53, which may be used to secure the fender 51 to objects such as a flexible linkage 31 and/or a fender retainer 41.

FIG. 6 shows a perspective view of an example of a fender hanger device 100 according to various embodiments described herein. In this example, the device 100 comprises a hanger block 11 supporting a fender 51 in a second position 72 (generally horizontally) via two flexible linkages 31. A first flexible linkage 31 may be coupled to the first fender aperture 52, such as with a linkage fastener 33, by tying the body 32, or any other suitable method, and to the hanger block 11 preferably, by positioning the body 32 through the channel 16 and block aperture 18. A second flexible linkage 31 may be coupled to the second fender aperture 53, such as with a linkage fastener 33, by tying the body 32, or any other suitable method, and to the hanger block 11 preferably, by positioning the body 32 through the channel 16. Each flexible linkage 31 may be removably coupled to the hanger block 11 by inserting its respective body 32 through the channel 16 with a linkage fastener 33 received in the cavity 15.

The distance between the hanger block 11 and the first fender aperture 52 and second fender aperture 53 may be changed by engaging or removably coupling different linkage fasteners 33 of the flexible linkages 31 in the cavity 15 of the hanger block 11. By changing the distance between the hanger block 11 and the first fender aperture 52 and/or second fender aperture 53, the fender 51 may be moved between the first 71 (generally vertical) and second 72 (generally horizontal) positions into any number of positions or angles relative to the hanger block 11. Additionally, the distance between the hanger block 11 and the body fastener 34 may be changed by selecting which linkage fastener 33 or by positioning a linkage fastener 33 below block aperture 18 so that while the body 32 of the flexible linkage 31 is slidably coupled within the block aperture 18, the linkage fastener 33 limits the movement of the body 32 through the block aperture 18.

Figure 7:
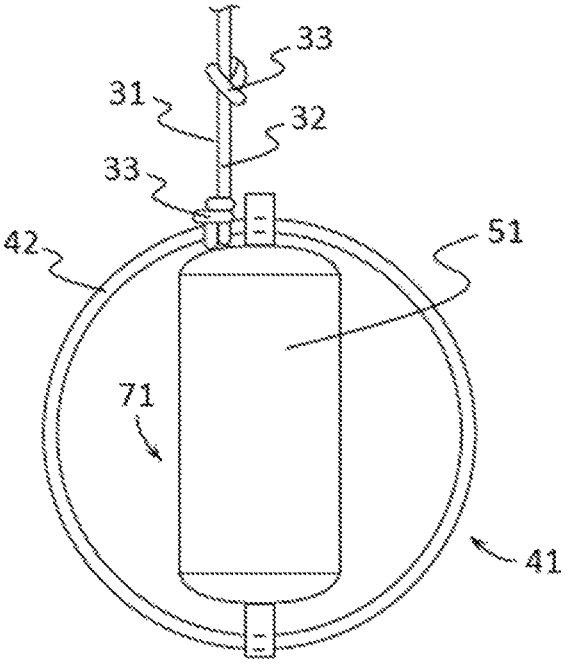
FIG. 7 depicts a front elevation view of an example of a fender retainer fender hanger device with a fender in a first position according to various embodiments described herein.
Figure 8:
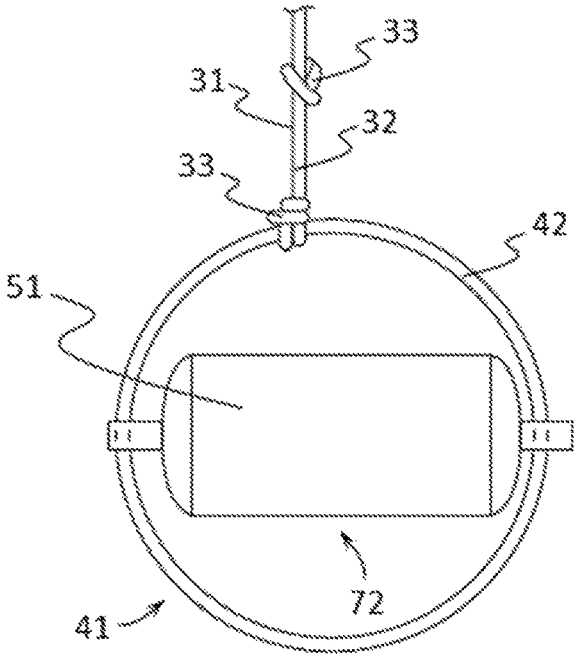
FIG. 8 illustrates a front elevation view of an example of a fender retainer fender hanger device with a fender in a second position according to various embodiments described herein.
Figure 9:
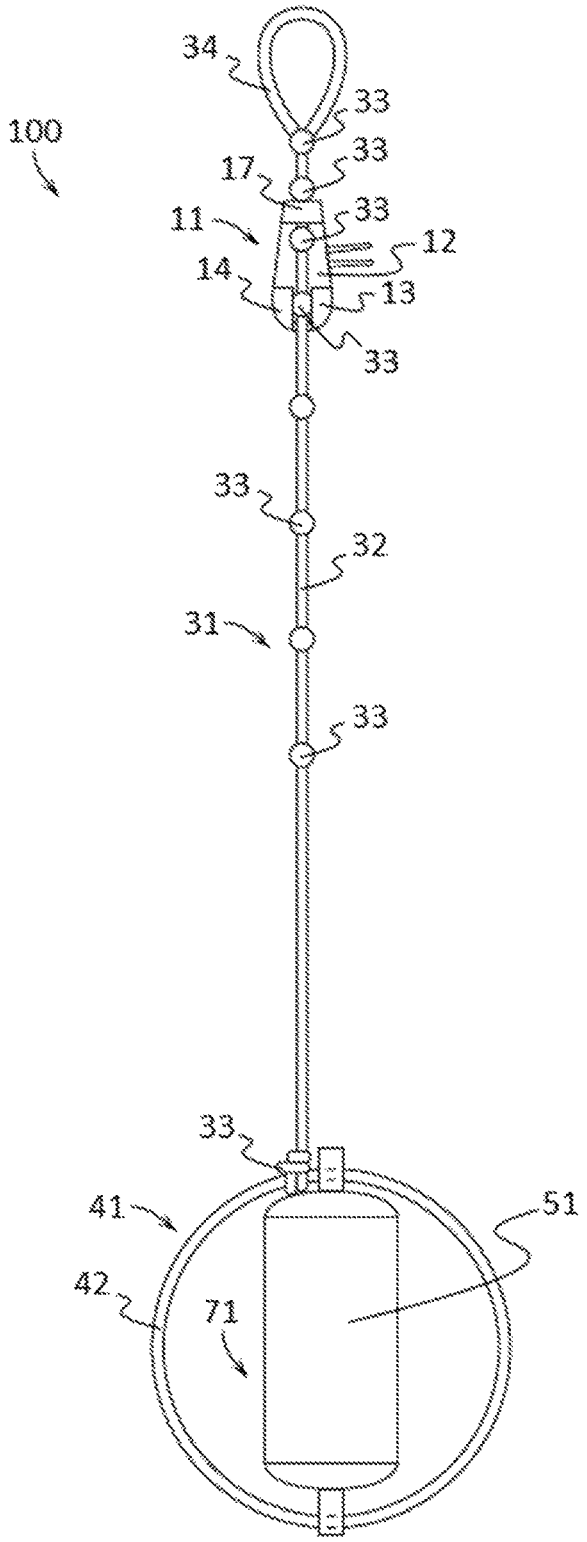
FIG. 9 shows a perspective view of another example of a fender hanger device according to various embodiments described herein.

As perhaps best shown in FIGS. 7-9, in some embodiments, the device 100 may comprise a fender retainer 41 which may be used to couple a fender 51 to a flexible linkage 31. A fender retainer 41 may be used to facilitate the positioning of a fender 51 into a first 71, second 72, or any other position. In some embodiments, a fender retainer 41 and a fender 51 may be integrally formed or molded together. In other embodiments, a fender 51 may comprise a first fender aperture 52 and a second fender aperture 52 which may be used to couple a fender retainer 41 to a fender 51. For example, a first fender aperture 52 and the second fender aperture 53 may both receive a portion of the fender retainer 41.

A fender retainer 41 may comprise an annular frame 42 to which a fender 51 and a flexible linkage 31 may both be coupled to. In some embodiments, the annular frame 42 may be substantially rigid and able to maintain a substantially circular or ring shape while being supported by a flexible linkage 31. The annular frame 42 may be made from or comprise a substantially rigid material such as steel alloys, aluminum, aluminum alloys, copper alloys, any other type of metal or metal alloy, various types of hard plastics, such as polyethylene (PE), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials that are substantially rigid. In other embodiments, the annular frame 42 may be substantially flexible and not able to maintain a substantially circular or ring shape while being supported by a flexible linkage 31. The annular frame 42 may be made from or comprise a substantially flexible material such as rope, cable, chain, string, strap, webbing, or any other material including combinations of materials that are substantially flexible and able to be malleable in shape.

In some embodiments, a fender 51 may be movably coupled to the fender retainer 41 so that the fender 51 may be moved relative to the fender retainer 41. For example, portions of the annular frame 42 may be slidably received through the first fender aperture 52 and second fender aperture 53 of the fender 51 thereby allowing the fender 51 to be moved between a first 71 and second 72 position. In this manner, a fender 51 coupled to the flexible linkage 31, via a fender retainer 41, may be movably coupled to the flexible linkage 31.

In some embodiments, a fender retainer 41 may be movably coupled to the flexible linkage 31 so that the fender retainer 41, and therefore a fender 51 coupled to the fender retainer 41, may be moved relative to the flexible linkage 31. For example, portions of the annular frame 42 may be slidably or movably coupled to the flexible linkage, optionally via a linkage fastener 33, thereby allowing the fender retainer 41 and fender 51 to be moved between a first 71 and second 72 position. In this manner, a fender 51 coupled to the flexible linkage 31, via a fender retainer 41, may be movably coupled to the flexible linkage 31.

FIG. 9 shows a perspective view of another example of a fender hanger device 100 according to various embodiments described herein. In this example, the device 100 comprises a hanger block 11 supporting a fender 51 in a first position 71 (generally vertically) via a flexible linkage 31 and a fender retainer 41. The body 32 of the flexible linkage 31 may be coupled to the flexible linkage 31 via the fender retainer 41. Additionally, the body 32 may also be removably coupled to the hanger block 11 by inserting the body 32 through the channel 16 with a linkage fastener 33 received in the cavity 15, while the body 32 may also be slidably coupled within the block aperture 18 with a linkage fastener 33 limiting the movement of the body 32 through the block aperture 18. The fender 51 may be movably coupled to the fender retainer 41 and/or the fender retainer 41 may be movably coupled to the flexible linkage 31.

The distance between the hanger block 11 and the first fender aperture 52 and second fender aperture 53 may be changed by engaging or removably coupling different linkage fasteners 33 of the flexible linkage 31 in the cavity 15 of the hanger block 11. By changing the distance between the hanger block 11 and the first fender aperture 52 and/or second fender aperture 53, the fender 51 may be moved between the first 71 (generally vertical) and second 72 (generally horizontal) positions into any number of positions or angles relative to the hanger block 11. Additionally, the distance between the hanger block 11 and the body fastener 34 may be changed by selecting which linkage fastener 33 or by positioning a linkage fastener 33 below block aperture 18 so that while the body 32 of the flexible linkage 31 is slidably coupled within the block aperture 18, the linkage fastener 33 limits the movement of the body 32 through the block aperture 18.

While some materials have been provided, in other embodiments, the elements that comprise the device 100 such as a hanger block 11, flexible linkage 31, linkage fasteners 33, optional fender retainer 41, optional prongs 27, 28, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A fender hanging device, the device comprising a hanger block, the hanger block comprising:

a back plate coupled to a first arm and to a second arm;

a cavity formed between the back plate, the first arm, and the second arm;

a channel separating the first arm and second arm;

a first prong having a first barb protruding away from the first prong and a second prong having a second barb protruding away from the second prong, the first prong and the second prong configured to be removably coupled to a fender;

an upper limiter coupled to the back plate opposite the first arm and second arm; and a block aperture passing through the upper limiter.

2. The device of claim 1, wherein the block aperture is oriented towards the cavity.

3. The device of claim 1, wherein the first prong and the second prong are constructed from a flexible material and are configured to flex towards and away from each other in order to facilitate coupling and uncoupling to a fender aperture.

4. The device of claim 1, wherein the hanger block comprises a cushion.

5. The device of claim 1, further comprising a flexible linkage having a body with a linkage fastener coupled to the body.

6. The device of claim 5, wherein the flexible linkage is removably coupled to the hanger block by inserting the body through the channel with the linkage fastener received in the cavity.

7. The device of claim 5, wherein the body of the flexible linkage is slidably coupled within the block aperture, and wherein the linkage fastener limits the movement of the body through the block aperture and the block aperture comprises a beveled edge.

8. The device of claim 5, wherein the flexible linkage is coupled to a fender.

9. The device of claim 8, wherein the fender is coupled to the flexible linkage with a fender retainer.

10. The device of claim 9, wherein the fender is movably coupled to the flexible linkage.

11. A fender hanging device, the device comprising:

a flexible linkage having a body;

a fender retainer moveably coupled to the flexible linkage, the fender retainer having an annular frame; and a fender having opposite ends, the ends of the fender each having a fender aperture moveably coupled to and encircled by the annular frame, and wherein the fender is movable between a first horizontal position relative to the flexible linkage and a second vertical position relative to the flexible linkage.

12. The device of claim 11, wherein the annular frame comprises a substantially rigid material that is able to maintain the annular frame in a substantially circular or ring shape.

13. The device of claim 11, wherein the annular frame comprises a substantially flexible material selected from the group consisting of rope, cable, chain, string, strap, and webbing.

14. The device of claim 11, further comprising a hanger block, the hanger block comprising:

a back plate coupled to a first arm and to a second arm;

a cavity formed between the back plate, the first arm, and the second arm;

a channel separating the first arm and second arm;

a first prong having a first barb protruding away from the first prong and a second prong having a second barb protruding away from the second prong, the first prong and the second prong configured to be removably coupled to a fender;

an upper limiter coupled to the back plate opposite the first arm and second arm; and a block aperture passing through the upper limiter.

15. The device of claim 14, wherein the hanger block comprises a cushion.

16. The device of claim 14, wherein the first prong and the second prong are constructed from a flexible material and are configured to flex towards and away from each other in order to facilitate coupling and uncoupling to a fender aperture.

17. The device of claim 14, wherein the flexible linkage is removably coupled to the hanger block by inserting the body through the channel, the body comprising a knot and the knot received in the cavity.

18. The device of claim 14, wherein the body of the flexible linkage is slidably coupled within the block aperture, the body comprising a knot for limiting movement of the body through the block aperture and the block aperture comprises a beveled edge.

* * * * *